US010689867B2

(12) United States Patent
King, Jr.

(10) Patent No.: US 10,689,867 B2
(45) Date of Patent: Jun. 23, 2020

(54) SYSTEM AND METHOD FOR DUST-FREE TILE REMOVAL TOOL

(71) Applicant: Skitter & Squirt Adventures, LLC, Missoula, MT (US)

(72) Inventor: Jack M. King, Jr., Phoenix, AZ (US)

(73) Assignee: Skitter & Squirt Adventures, LLC, Missoula, MT (US)

( * ) Notice: Subject to any disclaimer, the term of this patent is extended or adjusted under 35 U.S.C. 154(b) by 0 days.

(21) Appl. No.: 16/392,471

(22) Filed: Apr. 23, 2019

(65) Prior Publication Data

US 2019/0249452 A1 Aug. 15, 2019

(51) Int. Cl.
*B08B 5/04* (2006.01)
*E04G 23/00* (2006.01)

(52) U.S. Cl.
CPC ..... *E04G 23/006* (2013.01); *B08B 5/04* (2013.01)

(58) Field of Classification Search
CPC ..... B08B 5/04; E04G 23/006
See application file for complete search history.

(56) References Cited

U.S. PATENT DOCUMENTS 1,859,132 A 5/1932 Fechtenburg
3,739,422 A * 6/1973 Johnson ..... A47L 9/02 15/397
4,573,234 A 3/1986 Kochte
5,074,006 A 12/1991 Eremita
5,555,599 A * 9/1996 Markley ..... A47L 9/06 15/322
5,870,851 A * 2/1999 Shoemaker ..... A01K 13/002 119/626
6,435,592 B2 * 8/2002 Nilsson ..... B60N 2/4228 296/68.1
8,276,605 B2 * 10/2012 Heathcote ..... B01D 29/07 134/172
9,301,664 B1 * 4/2016 King, Jr. ..... A47L 7/00
2002/0189049 A1 * 12/2002 Freidell ..... A01K 13/002 15/402
2006/0124075 A1 * 6/2006 Matsumoto ..... A01K 13/001 119/601
2007/0113795 A1 * 5/2007 Hajjar ..... A01K 13/002 119/608
2009/0107413 A1 * 4/2009 Shiloni ..... A01K 13/002 119/609
2015/0026914 A1 * 1/2015 Meissner ..... A47L 11/34 15/321
2016/0066513 A1 * 3/2016 Gray ..... A01G 20/43 134/21

(Continued)

*Primary Examiner* — Alexander Markoff
(74) *Attorney, Agent, or Firm* — Lisa Foundation Patent Law Clinic at Arizona State University

(57) ABSTRACT

Dust free tile removal apparatus comprising a hollow base member, a hollow rake member, a plurality of rake tines, struts, and a handle. The hollow base member includes an opening that is configured to couple to a vacuum source at one end and is in fluid communication with the hollow rake member at another end. The connection of the hollow rake member with the hollow base member forms an obtuse angle. The hollow rake member has a top surface and a first end each having at least two openings. Rake tines extend outward from the first end of the hollow rake member. Struts extend from a bottom surface of the apparatus. The handle spans between the struts.

4 Claims, 6 Drawing Sheets

(56) References Cited

U.S. PATENT DOCUMENTS

| | | | | |
|---|---|---|---|---|
| 2016/0183747 | A1* | 6/2016 | King, Jr. | A01D 7/06 15/339 |
| 2016/0270612 | A1* | 9/2016 | Witter | A47L 9/06 |
| 2018/0110201 | A1* | 4/2018 | Mohyer, Jr. | A01K 13/001 |
| 2018/0288969 | A1* | 10/2018 | Freidell | A01K 13/002 |
| 2019/0039103 | A1* | 2/2019 | Morris, Sr. | A47L 11/4036 |
| 2019/0075985 | A1* | 3/2019 | King | A47L 9/02 |
| 2019/0249452 | A1* | 8/2019 | King, Jr. | B08B 5/04 |

* cited by examiner

SYSTEM AND METHOD FOR DUST-FREE TILE REMOVAL TOOL

BACKGROUND OF INVENTION

1. Technical Field

Aspects of this document relate generally to systems for using a tile removal raking apparatus capable of raking or otherwise gathering chipped tile while removing dust disturbed during the tile removal process.

2. Description of Related Art

Standard stand-up rakes are sometimes used in the tile removal process. After tile has been chipped away from a floor surface, standard stand-up rakes may be used to sweep up or otherwise gather and dispose of the leftover pieces of tile. However, these tools do not pick up dust that is disturbed and subsequently suspended in the air during the raking process. Free floating dust particles may be inhaled or otherwise consumed by rake users. Many of these particles can be toxic when consumed and may cause health problems to users over time.

Furthermore, stand-up rakes are often bulky and difficult to maneuver in tight spaces creating the risk of damage to walls, cabinets, and other objects.

SUMMARY OF THE INVENTION

The present disclosure provides a dust free tile removal tool. The dust free tile removal tool may include among other things a hollow base member 1. The hollow base member 1 may be any of a number of shapes and sizes. For example, in one embodiment of many, the hollow base member 1 may be rectangular and no larger than a shoe box. In another embodiment, the hollow base member 1 may be cylindrical. In yet other embodiments, the hollow base member may be a mixture of shapes. In a preferred embodiment, the hollow base member is substantially similar to a triangular prism with rectangular prisms on either end.

The hollow base member may include an opening 17 for receiving a vacuum source. The opening 17 may be configured to couple to a vacuum hose or other vacuum source. In a preferred embodiment the opening 17 is circular, but the opening may also be rectangular, triangular, square or any other shape capable of receiving a vacuum source. In one embodiment of many, a hollow cylinder 9 extends outward from the hollow base member 1 allowing a vacuum source such as a vacuum hose to couple to the cylinder 9. In other embodiments, a hollow rectangle or a hollow elliptical cylinder may extend from the hollow base member 1 and be configured to couple to a vacuum source.

The above described openings may be configured to couple to a vacuum source in many ways. In one embodiment, the opening 17 may be threaded to allow the vacuum hose to screw on. In another embodiment, the opening 17 or cylinder 9 may be a fitted shape and size that allows a vacuum hose to slide into the opening 17 or onto the cylinder 9 such that friction maintains the attachment. In other embodiments, attachment of a vacuum source may be achieved with clips, magnets, rivets, or any other connection mechanism capable of attaching a vacuum source to the dust free tile removal tool.

The dust free tile removal tool may further comprise a hollow rake member 3 that is in fluid communication with the hollow base member 1. The connection of the hollow rake member 3 and the hollow base member 1 may form an obtuse angle. Substantially opposite the end 12 of the hollow rake member 3 that is in fluid communication with the hollow base member 1, the hollow rake member 3 may have openings 15 to allow dust to flow through the dust free tile removal tool. The hollow rake member 3 may also have openings 13 on a top surface 10. The openings may be circular, elliptical, rectangular, triangular, square, amorphous or any other shape or combination of shapes through which air may flow. The size of the openings may be as large as four inches on their longest side and as small as one millimeter or less. In a preferred embodiment, the openings are rectangular with two hemispheres on either end of the rectangle. In some embodiments in which the openings are circular, the openings may be up to two inches in diameter. In other embodiments win which the openings are circular, the openings may be as small as one millimeter in diameter. The hollow rake member 3 may be any of a number of shapes. In a preferred embodiment the hollow rake member 3 is a rectangular prism with openings 13 on a top surface 10 and openings 15 on a front surface 14. In other embodiments the hollow rake member 3 may be a triangular prism, cube, or a combination of shapes.

The hollow rake member 3 may further include rake tines 11 extending outward from the hollow rake member 3. There may be as many or as few rake tines 11 as are necessary to rake or otherwise gather chipped tile material. In a preferred embodiment there may be six rake tines 11 spread evenly and extending from the hollow rake member 3. In some embodiments, however, there may be only two rake tines 11 or twenty or more rake tines 11. In some embodiments, openings 15 may exist between the rake tines 11 in the hollow rake member 3. Each of the rake tines 11 may be any substantially rigid material. In some embodiments, the rake tines 11 may be made of metal such as steel, iron, or titanium. In another embodiment the rake tines 11 may be plastic, rubber, glass, or a synthetic or composite material. In yet another embodiment, the rake tines 11 may be made up of different materials in different parts of the rake tines 11. For example, the outermost portion of the rake tines 11 may be plastic while the portion of the rake tines 11 connected to the hollow rake member 3 is metal.

The dust free tile removal tool may further comprise a left strut 5 and a right strut 4 extending from a bottom surface 19 of the dust free tile removal tool. In one embodiment the left strut 5 and the right strut 4 may be attached to a bottom surface 19 of the hollow base member 1. In another embodiment the struts may be attached to a bottom surface of the hollow rake member. One of ordinary skill in the art would appreciate that the struts may be any shape and material capable of transferring force from a handle 7 to the dust free tile removal tool. In some embodiments the dust free tile removal tool may have a single strut connected to the handle near its midpoint. In other embodiments, a single strut may be attached to the handle at one end. One of ordinary skill in the art would appreciate that the struts may be any length sufficient to allow a human hand to comfortably fit between a handle 7 and the hollow base member 1.

A handle 7 may span between the left strut 5 and the right strut 4. The handle 7 may be located a sufficient distance from the vacuum end 2 of the hollow base member 1 to allow the user's forearm to make contact with the hollow base member 1. The force couple formed by the downward force exerted by the user on the handle 7 and the upward force from the forearm to the hollow base member 1 may allow the user to exert force from the rake tines on chipped tile material. Without the contact point between the forearm and the hollow base member 1, a user's hand may simply rotate around the handle 7 when attempting to rake up tile material.

The handle 7 may be any shape that enables a hand to wrap around it. In some embodiments the handle 7 is cylindrical. In other embodiments the handle 7 may have grooves for fingers. In yet other embodiments, the handle 7 may have depressions or protrusions such as small nodes that improve grip. In a preferred embodiment the handle 7 is an elliptical cylinder. The handle may also be made of any material including rubber, plastic, metal, or a composite or synthetic material. Furthermore, the handle 7 may be solid or hollow.

Aspects and applications of the invention presented here are described below in the drawings and detailed description of the invention. Unless specifically noted, it is intended that the words and phrases in the specification and the claims be given their plain, ordinary, and accustomed meaning to those of ordinary skill in the applicable arts. The inventor is fully aware that he can be his own lexicographer if desired. The inventor expressly elects, as his own lexicographers, to use only the plain and ordinary meaning of terms in the specification and claims unless he clearly states otherwise and then further, expressly sets forth the "special" definition of that term and explains how it differs from the plain and ordinary meaning. Absent such clear statements of intent to apply a "special" definition, it is the inventor's intent and desire that the simple, plain and ordinary meaning to the terms be applied to the interpretation of the specification and claims.

The inventor is also aware of the normal precepts of English grammar. Thus, if a noun, term, or phrase is intended to be further characterized, specified, or narrowed in some way, then such noun, term, or phrase will expressly include additional adjectives, descriptive terms, or other modifiers in accordance with the normal precepts of English grammar. Absent the use of such adjectives, descriptive terms, or modifiers, it is the intent that such nouns, terms, or phrases be given their plain, and ordinary English meaning to those skilled in the applicable arts as set forth above.

Further, the inventor is fully informed of the standards and application of the special provisions of AIA 35 U.S.C. § 112(f). Thus, the use of the words "function," "means" or "step" in the Detailed Description or Description of the Drawings or claims is not intended to somehow indicate a desire to invoke the special provisions of AIA 35 U.S.C. § 112(f), to define the invention. To the contrary, if the provisions of AIA 35 U.S.C. § 112(f) are sought to be invoked to define the inventions, the claims will specifically and expressly state the exact phrases "means for" or "step for, and will also recite the word "function" (i.e., will state "means for performing the function of [insert function]"), without also reciting in such phrases any structure, material or act in support of the function. Thus, even when the claims recite a "means for performing the function of . . . " or "step for performing the function of . . . ," if the claims also recite any structure, material or acts in support of that means or step, or that perform the recited function, then it is the clear intention of the inventor not to invoke the provisions of AIA 35 U.S.C. § 112(f). Moreover, even if the provisions of AIA 35 U.S.C. § 112(f) are invoked to define the claimed inventions, it is intended that the inventions not be limited only to the specific structure, material or acts that are described in the preferred embodiments, but in addition, include any and all structures, materials or acts that perform the claimed function as described in alternative embodiments or forms of the invention, or that are well known present or later-developed, equivalent structures, material or acts for performing the claimed function.

The foregoing and other aspects, features, and advantages will be apparent to those artisans of ordinary skill in the art from the DETAILED DESCRIPTION and DRAWINGS, and from the CLAIMS

BRIEF DESCRIPTION OF THE DRAWINGS

A more complete understanding of the present invention may be derived by referring to the detailed description and claims when considered in connection with the following illustrative figures. In the following figures, like reference numbers refer to similar elements and steps throughout the figures.

Elements and steps in the figures are illustrated for simplicity and clarity and have not necessarily been rendered according to any particular sequence. For example, steps that may be performed concurrently or in different order are illustrated in the figures to help to improve understanding of embodiments of the present invention.

DETAILED DESCRIPTION OF EXEMPLARY EMBODIMENTS

In the following description, and for the purposes of explanation, numerous specific details are set forth in order to provide a thorough understanding of the various aspects of the invention. It will be understood, however, by those skilled in the relevant arts, that the present invention may be practiced without these specific details. In other instances, known structures and devices are shown or discussed more generally in order to avoid obscuring the invention. In many cases, a description of the operation is sufficient to enable one to implement the various forms of the invention. It should be noted that there are many different and alternative configurations, devices and technologies to which the disclosed inventions may be applied. The full scope of the inventions is not limited to the examples that are described below.

In one application, a novel system for raking chipped tile and removing associated dust is provided.

Figure 2:
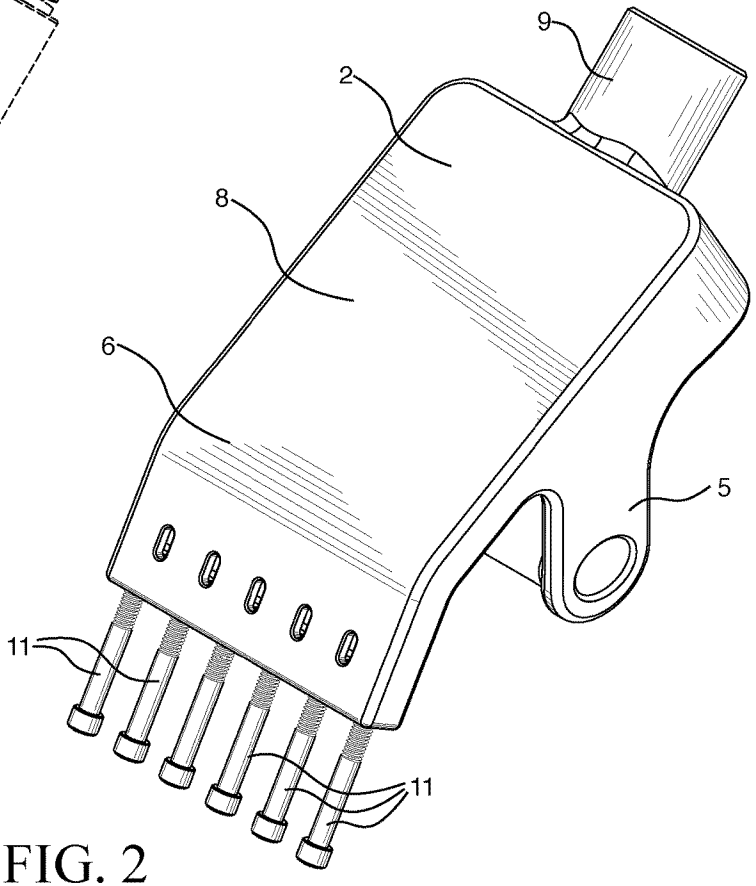
FIGS. 1 and 2 depict perspective views of an implementation of a dust free tile removal tool.
Figure 1:
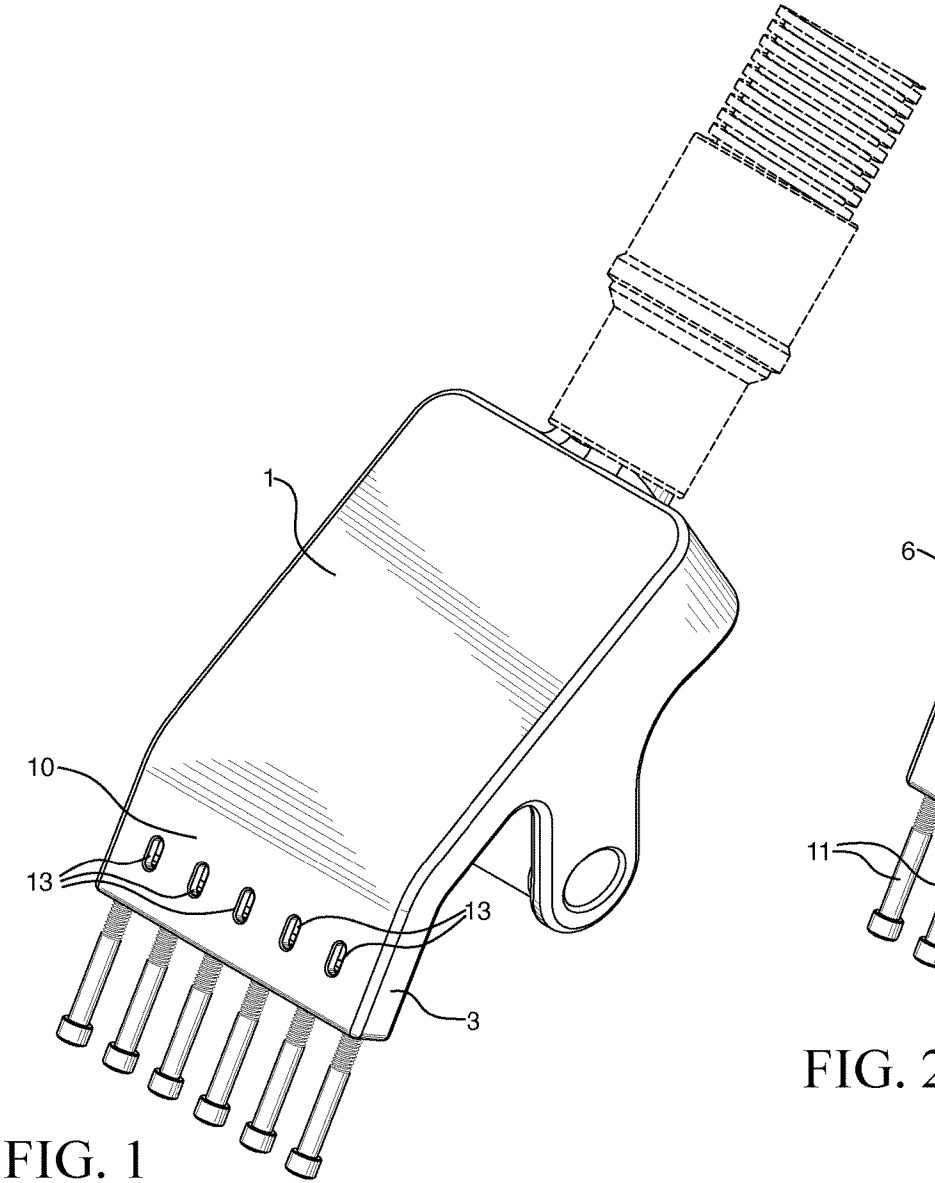

FIGS. 1 and 2 illustrate an exemplary embodiment of a dust free tile removal tool. In one non-limiting embodiment, the hollow base member 1 is in fluid communication with the hollow rake member 3 on one end 6 and is in fluid communication with the hollow cylinder 9 on another end 2. In other embodiments the hollow base member 1 may have a different shape or size. The hollow rake member 3 in the particular exemplary embodiment shown is a substantially rectangular prism and has a plurality of openings 13 along a top surface 10. Further, in the particular exemplary embodiment shown, rake tines 11 extend outward from a front surface 14 of the hollow rake member 3. In other embodiments the rake tines 11 may be longer or shorter and may have a different shape or be separated by more or less distance. Further shown in the particular embodiment depicted in FIGS. 1 and 2, is the left strut 5 which attaches on one end to the hollow base member 1 and, on another end, attaches to one end of a handle 7. In other embodiments, the strut 5 may be a different shape or connected to the hollow base member 1 in a different location or by a different means. It can be appreciated by those of ordinary skill in the art that the left strut 5 can have multiple variations.

In additional embodiments, the hollow cylinder 9 may not be desired.

In those embodiments, there may be an opening 17 in the hollow base member 1 configured to couple to a vacuum source.

Figure 3:
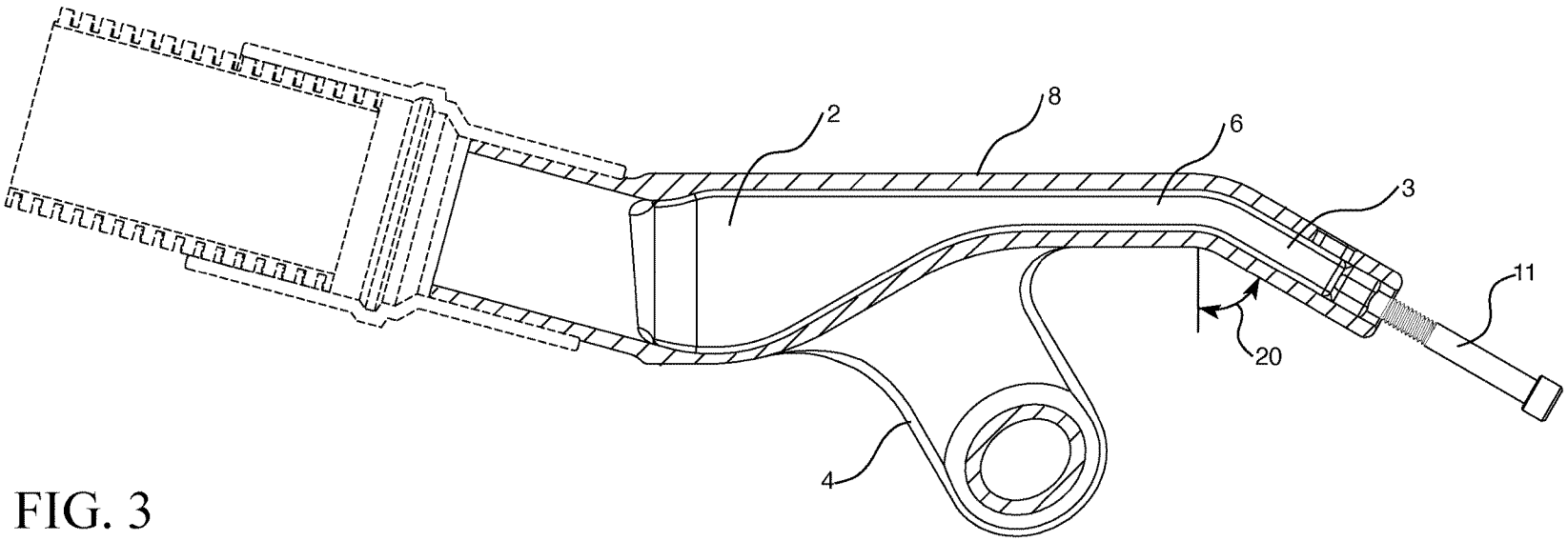
FIGS. 3 and 4 depict side views of an implementation of a dust free tile removal tool.
Figure 4:
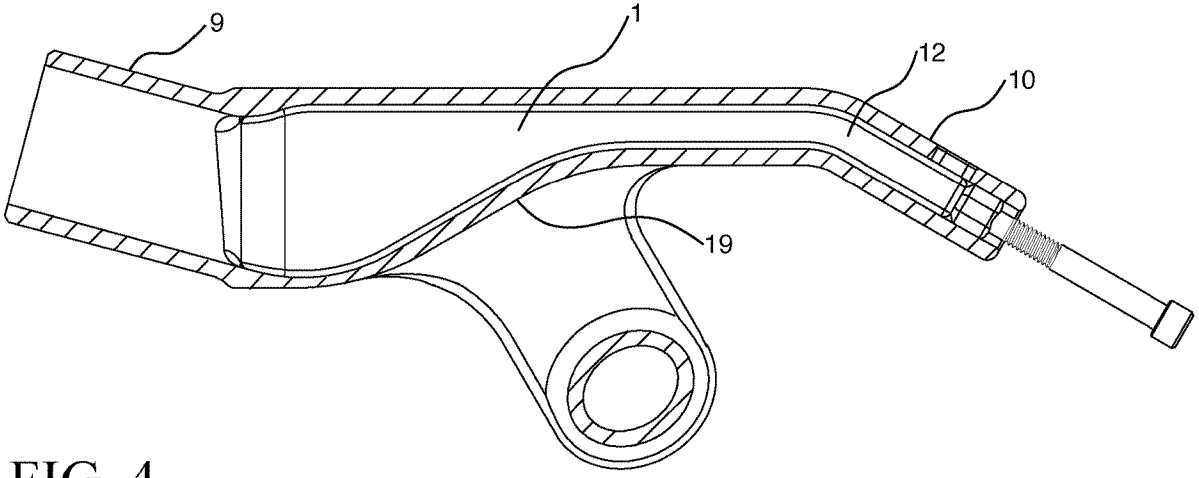

FIGS. 3 and 4 illustrate side views of an implementation of a dust free tile removal tool. The exemplary embodiment shown depicts the hollow base member 1 as a combination of a rectangular prism on one end 6 and a substantially triangular prism on another end 2 with a flat top surface 8 and a partially sloped and flat bottom surface 19. However, those of ordinary skill in the art would appreciate that the hollow base member 1 may be any shape through which air containing dust may flow to a vacuum source. Further shown is the oblique angle created by the connection of the hollow rake member 3 and the hollow base member 1. Additionally illustrated is the hollow cylinder 9 connected at an oblique angle with respect to the top surface of the hollow base member 1. In other embodiments not shown, the connection between the hollow cylinder 9 and the hollow base member 1 may form a different angle including but not limited to a zero-degree angle.

Figure 5:
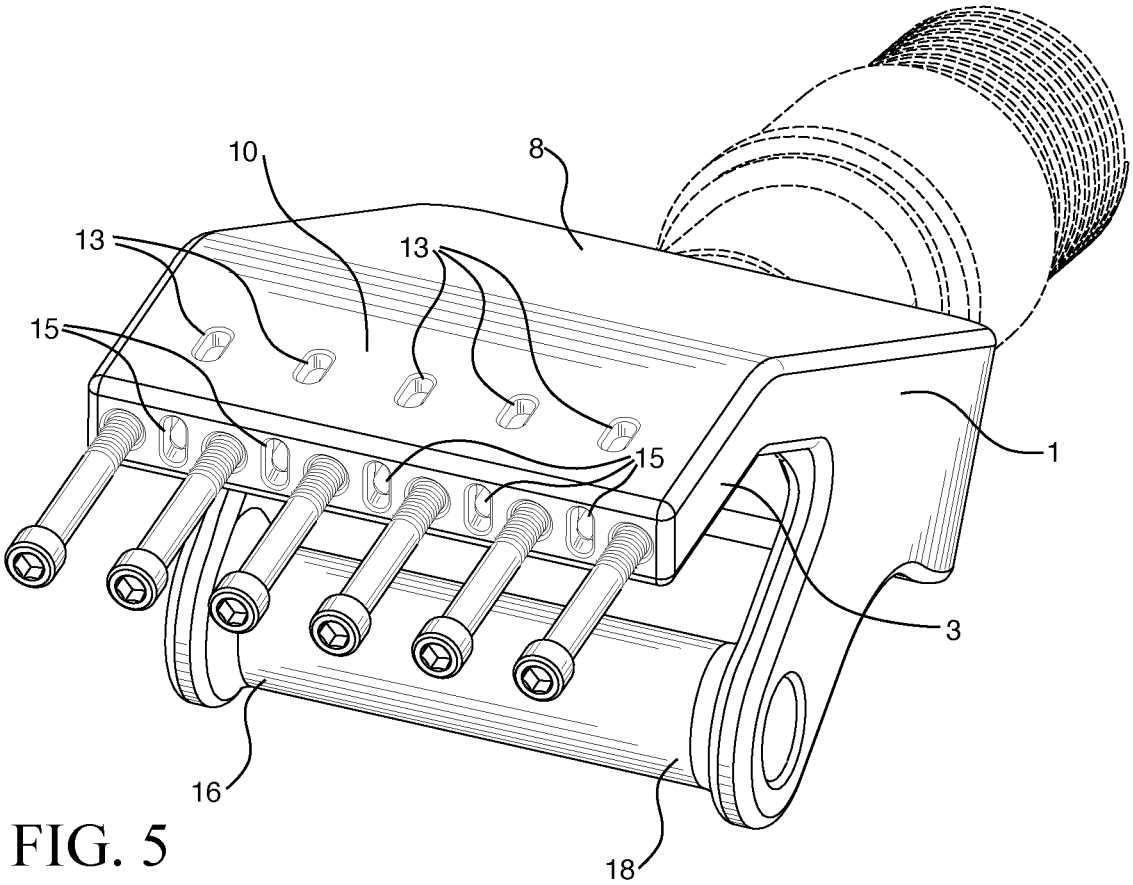
FIGS. 5 and 6 depict oblique frontal views of an implementation of a dust free tile removal tool.
Figure 6:
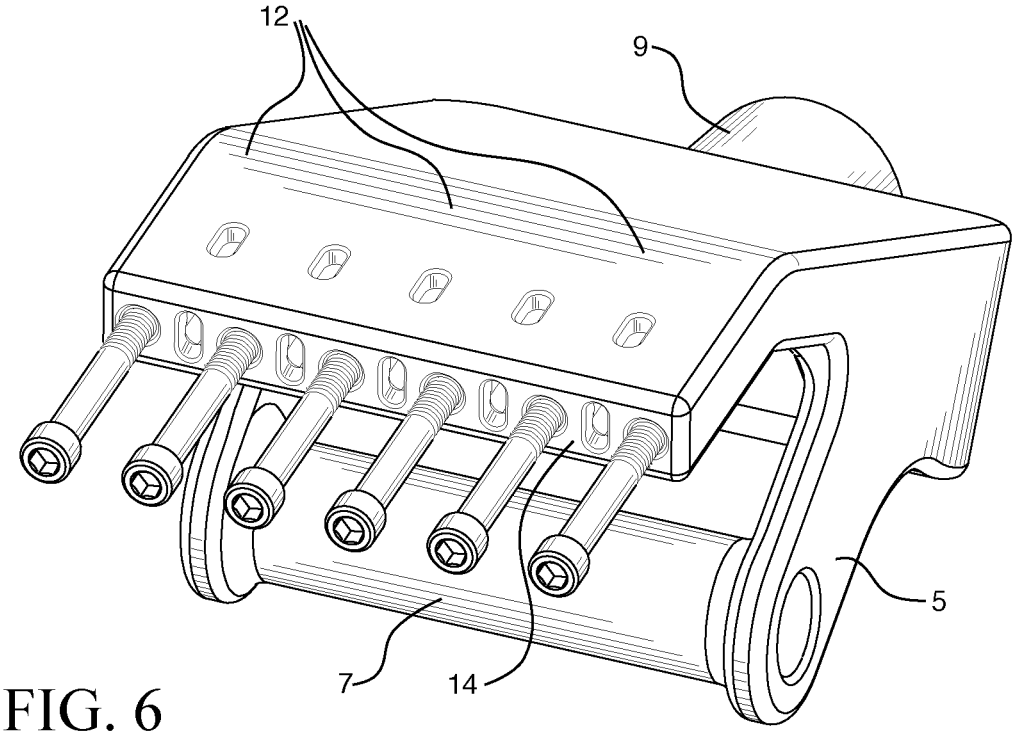

FIGS. 5 and 6 illustrate an oblique frontal view of an implementation of a dust free tile removal tool. The particular exemplary embodiment shown includes openings 13 on a top surface 10 of the hollow rake member 3. Further shown are openings 15 on a front surface 14 of the hollow rake member 3. The exemplary embodiment shown further depicts a configuration in which the rake tines 11 are coupled to and extend outward from a front surface 14 of the hollow rake member 3. The particular exemplary embodiment shown further includes the handle 7 coupled to a right strut 4 and a left strut 5 that, themselves, are further coupled to the hollow base member 1.

Figures 7, 8:
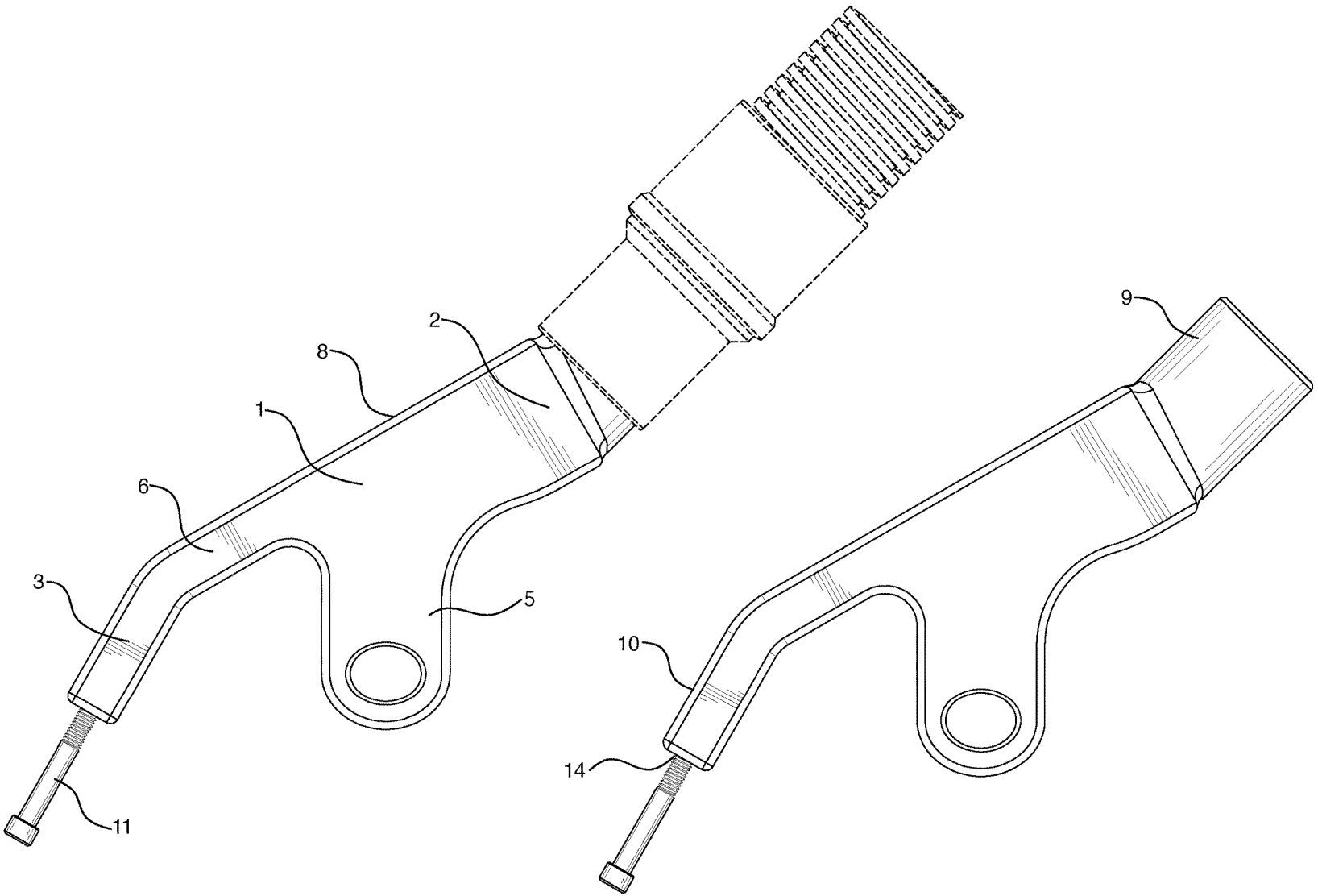
FIGS. 7 and 8 depict side views of an implementation of a dust free tile removal tool from a second view.

FIGS. 7 and 8 illustrate a side view of an implementation of a dust free tile removal tool from a second view.

Figures 9, 10:
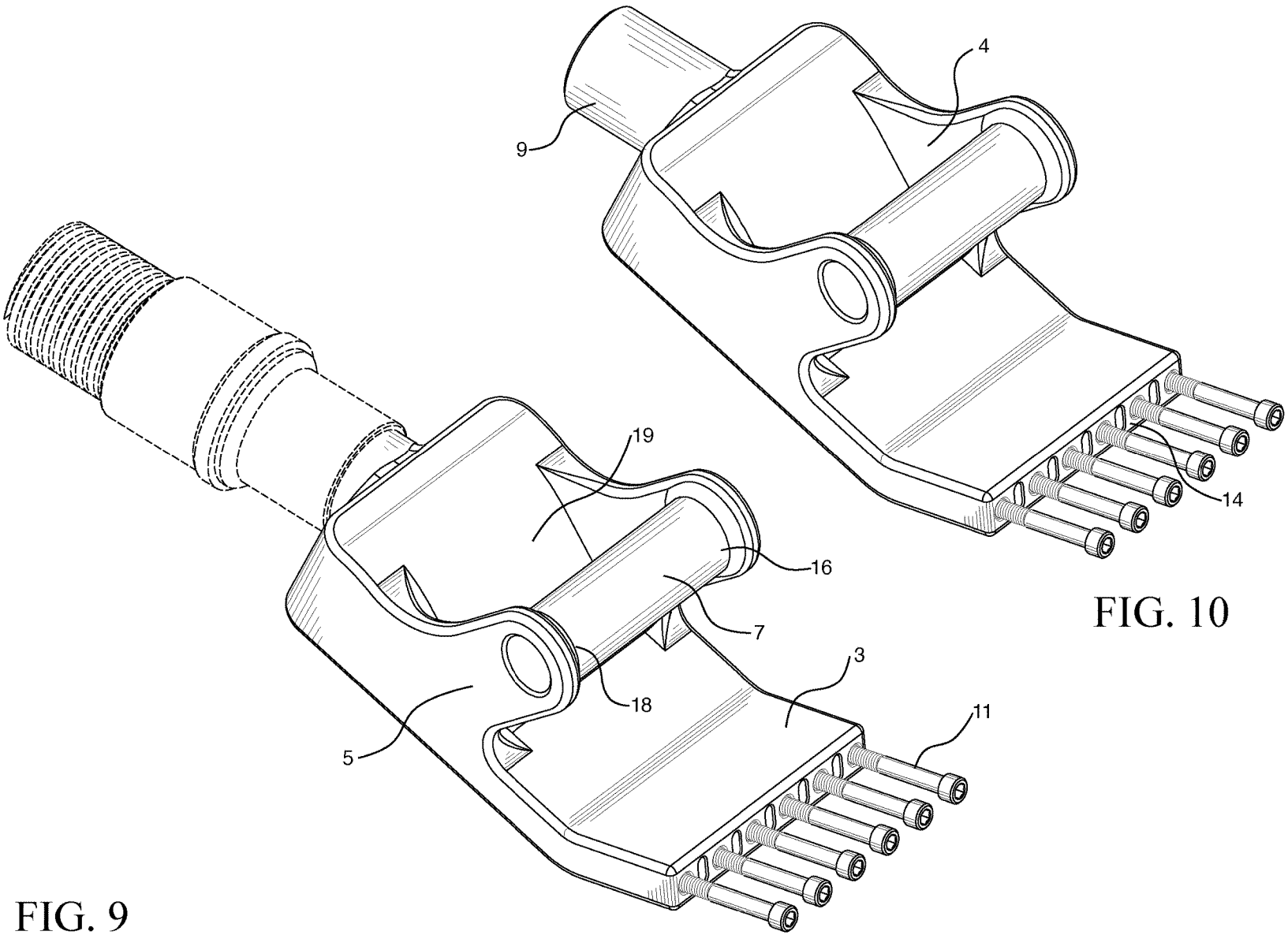
FIGS. 9 and 10 depict oblique views of an implementation of an adapter handle from a third view.

FIGS. 9 and 10 illustrate an oblique view of an implementation of a dust free tile removal tool. Specifically shown is an exemplary embodiment in which the handle 7 spans between a left strut 5 and a right strut 4. The particular embodiment shown depicts the left strut 5 and right strut 4 as being connected to a bottom surface 19 of the hollow base member 1. In other embodiments the left strut 5 and right strut 4 may be connected instead to the hollow rake member 3.

Figure 12:
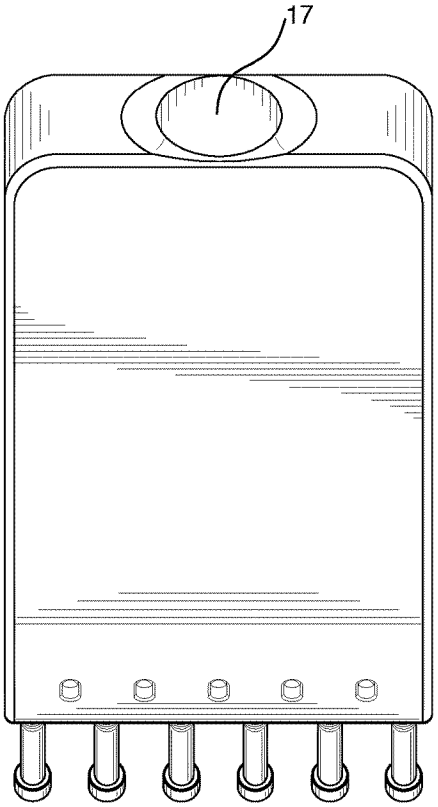
FIGS. 11 and 12 depict an oblique of an implementation of a dust free tile removal tool from a fourth view.
Figure 11:
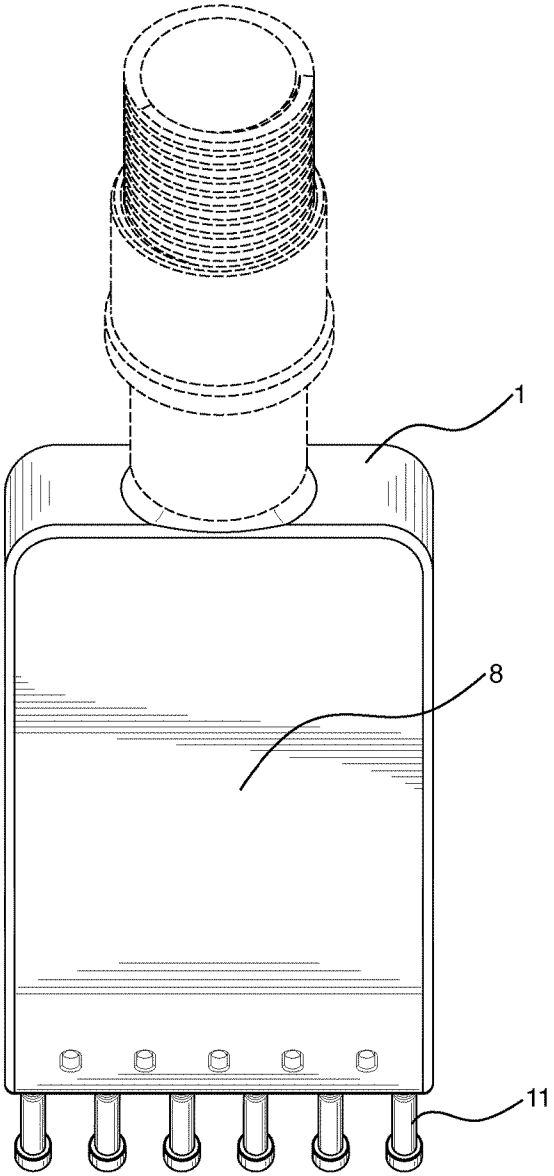

FIGS. 11 and 12 illustrate a top oblique view of an implementation of a dust free tile removal tool. The particular embodiment shown depicts a circular or cylindrical opening 17 at one end 2 of the hollow base member 1 configured to couple to a vacuum hose or other vacuum source. In other embodiments the opening may be a different shape. Further, the opening 17 may also be threaded, lined with magnets or a rubber gasket, or may contain rivets, guides, or any other locking or connection mechanism capable of enabling the attachment of a vacuum source to the hollow base member 1 such that suction is generated at the openings in the hollow rake member 3.

In the foregoing specification, the invention has been described with reference to specific exemplary embodiments. Various modifications and changes may be made, however, without departing from the scope of the present invention as set forth in the claims. The specification and figures are illustrative, not restrictive, and modifications are intended to be included within the scope of the present invention. Accordingly, the scope of the invention should be determined by the claims and their legal equivalents rather than by merely the examples described.

For example, the steps recited in any method or process claims may be executed in any order and are not limited to the specific order presented in the claims. Additionally, the components and/or elements recited in any apparatus claims may be assembled or otherwise operationally configured in a variety of permutations and are accordingly not limited to the specific configuration recited in the claims.

Benefits, other advantages, and solutions to problems have been described above with regard to particular embodiments. Any benefit, advantage, solution to problem, or any element that may cause any particular benefit, advantage, or solution to occur or to become more pronounced are not to be construed as critical, required, or essential features or components of any or all the claims.

The terms "comprise", "comprises", "comprising", "having", "including", "includes" or any variations of such terms, are intended to reference a non-exclusive inclusion, such that a process, method, article, composition or apparatus that comprises a list of elements does not include only those elements recited, but may also include other elements not expressly listed or inherent to such process, method, article, composition or apparatus. Other combinations and/or modifications of the above-described structures, arrangements, applications, proportions, elements, materials, or components used in the practice of the present invention, in addition to those not specifically recited, may be varied or otherwise particularly adapted to specific environments, manufacturing specifications, design parameters, or other operating requirements without departing from the general principles of the same.

The invention claimed is:

1. A dust free tile removal tool connectable to a vacuum source, the dust free tile removal tool comprising:

a hollow base member comprising:

a first end; and a second end comprising an opening for receiving the vacuum source;

a hollow rake member comprising:

a top surface comprising a plurality of openings;

a first end comprising a plurality of openings, wherein the first end is substantially perpendicular to the top surface;

a second end in fluid communication with the first end of the hollow base member, wherein the top surface of the hollow rake member is positioned at an obtuse angle with respect to a plane corresponding to a top surface of the hollow base member;

a plurality of rake tines coupled to the first end of the hollow rake member and extending outward therefrom;

a first strut coupled to the hollow base member and a second strut coupled to the hollow base member, the first strut and the second strut extending outwardly from a bottom surface of the hollow base member; and a handle comprising a first end and a second end, the first end coupled to the first strut and the second end coupled to the second strut.

2. The dust free tile removal tool of claim 1, wherein the first strut and the second strut are coupled to the hollow rake member and extend outward therefrom.

3. The dust free tile removal tool of claim 1, further comprising a hollow cylinder coupled to the second end of the hollow base member and in fluid communication with the opening in the second end of the hollow base member, wherein the hollow cylinder is configured to receive the vacuum source.

4. The dust free tile removal tool of claim 1, wherein the second end of the hollow base member comprises an attachment configured to receive the vacuum source.

* * * * *